United States Patent [19]

Naya et al.

[11] Patent Number: 4,984,974

[45] Date of Patent: Jan. 15, 1991

[54] SCREW TYPE VACUUM PUMP WITH INTRODUCED INERT GAS

[75] Inventors: Koutarou Naya; Kazuaki Shiinoki, both of Shimizu; Tadashi Hayakawa, Kamakura; Kiyoshi Masujima, Chigasaki; Riichi Uchida, Ibaraki; Katsumi Matsubara, Ushiku, all of Japan

[73] Assignee: Hitachi, Ltd., Tokyo, Japan

[21] Appl. No.: 284,740

[22] Filed: Dec. 15, 1988

[30] Foreign Application Priority Data

Dec. 18, 1987 [JP] Japan ..... 62-318880

[51] Int. Cl.[5] ..... F04C 18/16; F04C 25/02; F04C 27/00; F16J 15/447

[52] U.S. Cl. ..... 418/87; 418/97; 418/98; 418/104; 418/201.1; 418/DIG. 1; 277/3; 277/79

[58] Field of Search ..... 418/15, 87, 97–99, 418/104, 201 R, 201 A, DIG. 1; 277/3, 71, 79

[56] References Cited

U.S. PATENT DOCUMENTS

| | | | |
|---|---|---|---|
| 3,307,777 | 3/1967 | Schibbye | 418/9 |
| 3,375,015 | 3/1968 | Swearingen | 277/3 |
| 3,919,854 | 11/1975 | Denis | 277/3 |
| 4,268,230 | 5/1981 | Bassan | 418/15 |
| 4,714,418 | 12/1987 | Matsubara et al. | 418/201 |
| 4,781,553 | 11/1988 | Nomura et al. | 418/104 |
| 4,808,095 | 2/1989 | Nishitani et al. | 418/99 |

FOREIGN PATENT DOCUMENTS

| | | | |
|---|---|---|---|
| 0156096 | 10/1985 | European Pat. Off. . | |
| 0166851 | 1/1986 | European Pat. Off. . | |
| 60-222583 | 11/1985 | Japan | 418/201 R |
| 62-210282 | 9/1987 | Japan | 418/104 |
| 2116634 | 9/1983 | United Kingdom . | |

*Primary Examiner*—John J. Vrablik

*Attorney, Agent, or Firm*—Antonelli, Terry, Stout & Kraus

[57] ABSTRACT

The screw type vacuum pump comprises a pump casing having a suction inlet and a discharge outlet, and a pair of rotors incorporated within the pump casing and meshing with each other to rotate in synchronized manner. The vacuum pump evacuates a reaction vessel, to which process gas is applied, to obtain a negative pressure condition of a predetermined level. Upon operation of the pump, inert gas is introduced into a compression working chamber directly or through a sealing portion disposed adjacent the discharge outlet. The introduced inert gas is adiabatically compressed therein to generate heat to heat the rotors and a casing wall. Further the inert gas effects a reduction of partial pressure of the process gas in the pump. Accordingly, a side reaction product is prevented from accumulating on the rotors and the casing wall.

8 Claims, 6 Drawing Sheets

SCREW TYPE VACUUM PUMP WITH INTRODUCED INERT GAS

BACKGROUND OF THE INVENTION

FIELD OF THE INVENTION AND RELATED ART STATEMENT

The present invention relates to a screw type vacuum pump, and, in particular, to an oil-free screw type vacuum pump suited for use in a device treating a process gas that generates reaction products in the pump during a manufacturing of semiconductors.

In, for example, Japanese Patent Unexamined Publication No. 60-216089 and corresponding U.S. Pat. No. (4,714,418) a screw type vacuum pump is proposed which is capable by itself of performing evacuation so as to achieve a low pressure of a level about $10^{-4}$ Torr. The pump is characterised in that working chambers thereof, defined by a male rotor, a female rotor and a casing, include two or three sealed sections between a suction port thereof and a discharge port thereof. The pump includes a working chamber for contributing a transfer stroke, which has been needed by conventional compressors. As the rotors of the pump rotate, the working chambers thereof contribute to the strokes of suction, transfer, compression and discharge, respectively.

When used as a vacuum pump for general gases such as air or nitrogen gas, the above-described conventional pump has no problems. However, when used in a nitride film producing process in a low pressure chemical vapor deposition (CVD) device for manufacturing semiconductors, the rotors of such pump can become locked, which may incapacitate the pump. This is attributable to the great amount of reaction products present on a discharge side of the rotors, in particular on surfaces of tooth spaces contributing to the compression and the discharge strokes and on casing wall surfaces which correspond to the tooth space surfaces.

OBJECT AND SUMMARY OF THE INVENTION

Accordingly an object of the present invention is to provide a screw type vacuum pump which can prevent such reaction products from accumulating on inner surfaces thereof so as to improve its reliability.

Another object of the present invention is provide a screw type vacuum pump which can prevent lubricating oil from entering into the working chambers thereof to obtain a clean vacuum.

Yet another object of the present invention is to provide a screw type vacuum pump in which lubricating oil separates from inert gas so as to improve the reliability of the lubrication.

To this end, according to the present invention, the pump is provided in a working chamber under the compression stroke with an inert gas introducing means through which inert gas in introduced thereinto.

A typical process for producing a silicon nitride film in a low-pressure CVD device may be expressed as follows:

$$3SiH_2Cl_2 + 10NH_3 \rightarrow SiN_4 + 6NH_4Cl + 6H_2$$

Ammonium chloride is generated as a side reaction product of this process. The higher the pressure becomes, the higher the deposition of ammonium chloride due to the vapor pressure characteristics thereof. As a result, in a screw type vacuum pump, ammonium chloride accumulates on the surfaces of the rotor portions and the casing portions which cooperate with each other to define working chambers contributing to the compression and the discharge strokes, respectively. When an inert gas such as nitrogen gas is introduced into the working chambers, a partial pressure or a concentration of ammonium chloride in the mixture of such introduced inert gas and ammonium chloride is lowered, so that it becomes harder, for the ammonium chloride to deposit.

Further, the inert gas in the working chambers is adiabatically compressed by pumping operation to heat the rotors and the casing wall. As a result, even though ammonium chloride is deposited as a side reaction product, it hardly adheres to or accumulates on the rotors and the casing wall.

In addition, the pump according to the present invention includes means for introducing an inert gas provided in one of sealing portions for pump rotor shaft bearing portions, which is located in a discharge side of the pump. A part of inert gas introduced into the discharge side sealing portion flows into the discharge side sealing portion, with the rest of the inert gas flowing towards the working chambers to lower the density of the side reaction product. Further, the inert gas in the working chambers is adiabatically compressed to heat the rotors and the casing wall so as to prevent the side reaction product from accumulating on the rotors and the casing wall. The inert gas introduced into the discharge side sealing portion prevents lubricating oil from leaking from the bearing portion to the working chambers through the discharge side sealing portion.

DETAILED DESCRIPTION OF THE PREFERRED EMBODIMENTS

Figure 1:
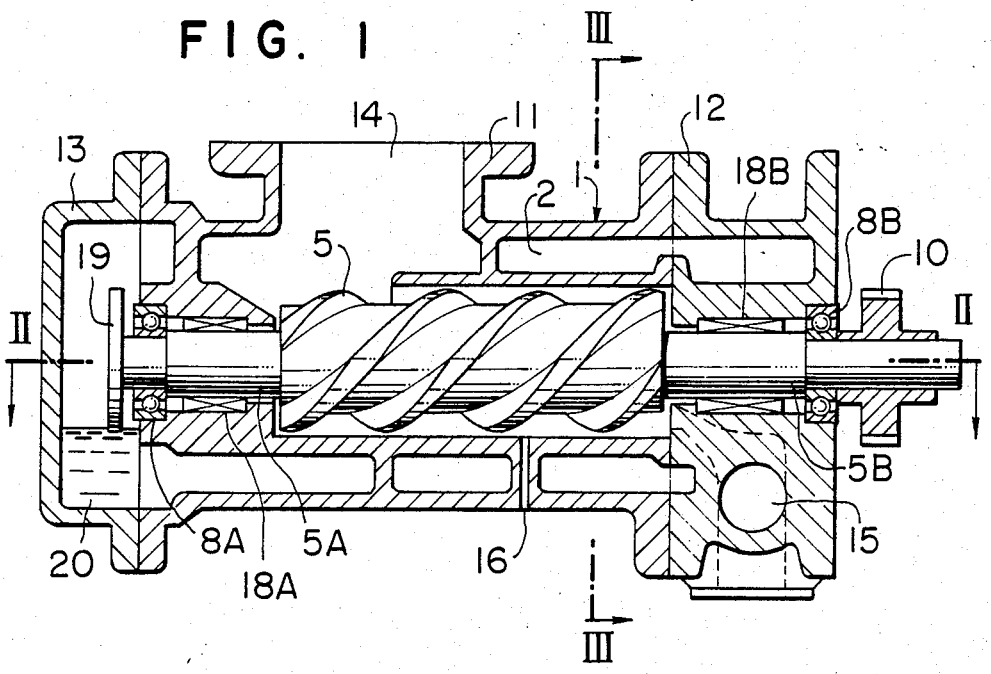
FIG. 1 is a longitudinal sectional view showing a screw type vacuum pump in accordance with one embodiment of the present invention.
Figure 2:
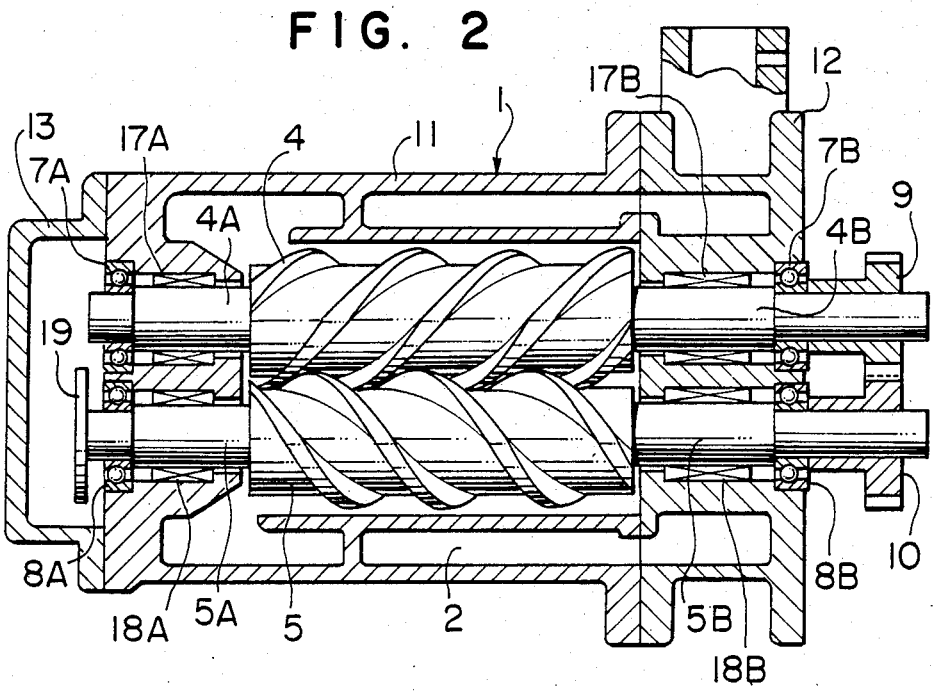
FIG. 2 is a sectional view taken along the line II—II of FIG. 1.
Figure 3:
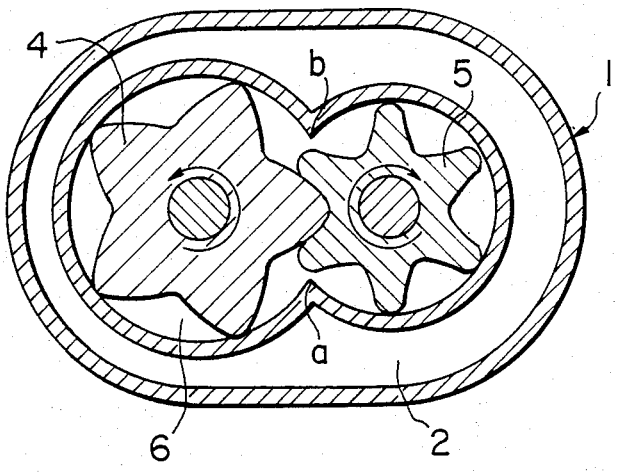
FIG. 3 is a sectional view taken along the line III—III of FIG. 1.

Referring to FIGS. 1 to 3, a pump according to one embodiment of the present invention includes a casing generally designated by the reference numeral 1, and a pair of rotors 4 and 5 accommodated within the casing 1. The casing 1 is constituted of a main casing portion 11, a discharge side casing portion 12 attached to one axial end of the main casing portion 11, and an end cover 13 attached to the other axial end of the main casing portion 11. The pair of rotors includes a male rotor 4 and a female rotor 5, each of which is provided with a plurality of spiral lands and a plurality of spiral grooves. The spiral lands of one of rotors mesh with the grooves of the other one. The rotors 4 and 5 cooperate with the main casing portion 11 and the discharge side casing portion 12 to define a working chamber means 6 therebetween. The main casing portion 11 is provided with a suction inlet 14 communicated to the working chamber means 6 and a gas purge hole 16 serving as an inert gas introducing means. The discharge side casing portion 12 is provided with a discharge outlet 15 communicated to the working chamber means 6. Further, the casing 1 is provided with a water jacket 2 through which water circulates to cool the rotors 4 and 5 and the casing 1.

The male rotor 4 is journaled at a suction side rotor shaft 4A and a discharge side rotor shaft 4B by for example, roller bearings 7A and 7B, respectively. The female rotor 5 is journaled at a suction side rotor shaft 5A and a discharge side rotor shaft 5B by, for example, roller bearings 8A and 8B, respectively.

The male rotor 4 and the female rotor 5 mesh with each other with a fine clearance therebetween and they rotate in synchronized manner by timing gear means including a male timing gear 9 mounted on the discharge side rotor shaft 4B, and a female timing gear 10 mounted on the discharge side rotor shaft 5B for meshing with the male timing gear 9. The bearings 7B and 8B and the timing gears 9 and 10 are lubricated by lubricating oil supplied by an oil pump (not shown) located outside of the vacuum pump. The male rotor 4 is sealed at the rotor shafts 4A and 4B by sealing means 17A and 17B, respectively. The female rotor 5 is also sealed at the rotor shafts 5A and 5B by sealing means 18A and 18B, respectively. The sealing means 17A, 17B, 18A and 18B serve to prevent lubricating oil from passing into the working chamber means 6 through the bearings 7A, 7B, 8A and 8B, and the timing gears 9 and 10.

In the embodiment of FIGS. 1–3, an oil scraping slinger 19 is provided at an end of the rotor shaft 5A and, upon rotation of the rotors 4 and 5, the slinger 19 splashes the bearings 7A and 8A with lubricating oil in an oil sump 20 defined by a part of the main casing 11 and a part of the end cover 13.

Figure 4:
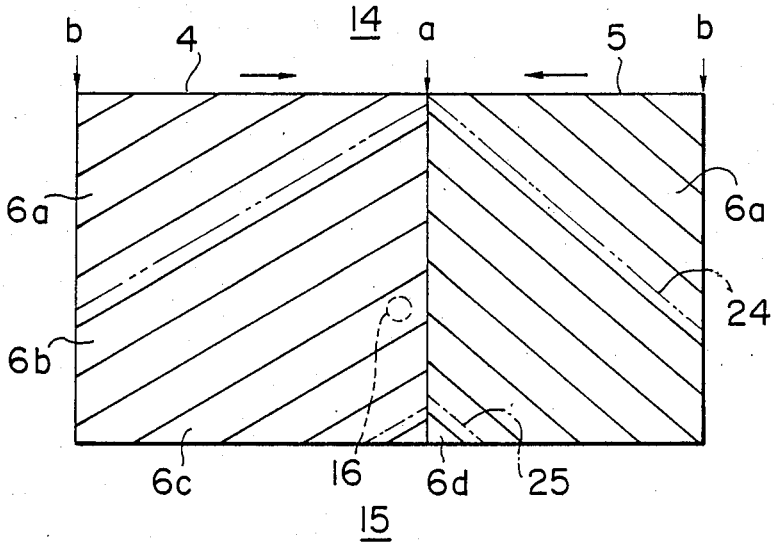
FIG. 4 is a view showing an engagement between tooth spaces of the rotors in FIG. 1.

FIG. 4 shows a development of the rotor tooth spaces of the rotors 4 and 5 with centering an intersectional line a between a male bore and a female bore. The two-dot chain line, the dashed line and the broken line indicate positions corresponding to a suction port 24, a discharge port 25 and the gas purge hole 16, respectively.

The working chamber means 6 is divided into a suction working chamber **6*a*, a transfer working chamber 6*b*, a compression working chamber 6*c* and a discharge working chamber 6*d***, respectively, with respect to a gas flow direction.

The vacuum pump explained above is connected at the suction side thereof to, for example, a vessel of a semiconductor manufacturing device, e.g. the low pressure CVD device so as to evacuate the vessel.

The operation of the above-mentioned screw type vacuum pump will be explained hereinunder with referring to FIGS. 1, 2 and 4 when applied to the process of manufacturing silicon nitride film with using dichlorsilane ($SiH_2Cl_2$) and ammonia ($NH_3$) as process gas.

When an external drive mechanism (not shown) drives the pump, the male rotor 4 and the female rotor 5 rotate to introduce the process gas into the suction working chamber **6*a* from the suction inlet 14 through the suction port 24. The process gas is delivered through the transfer working chamber 6*b* and the compression working chamber 6*c* to the discharge working chamber 6*d* and then discharged therefrom to the discharge outlet 15 through the discharge port 25. Namely, upon operation of the pump, the process gas flows from the suction inlet 14 to the discharge outlet 15** and during such operation the process gas is subjected to the suction stroke, the transfer stroke, the compression stroke and the discharge stroke in order.

Figure 5:
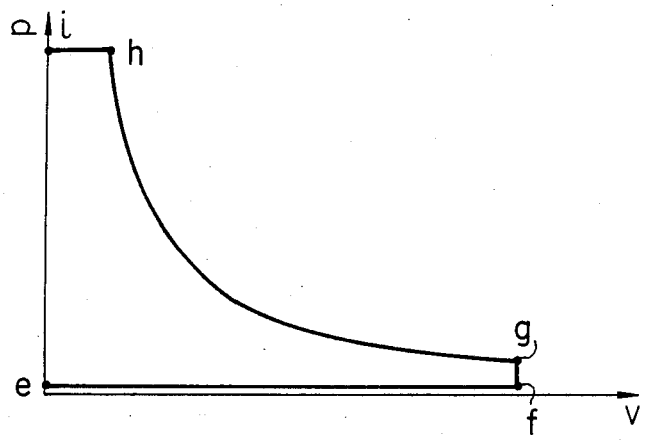
FIG. 5 is a p-v chart of the pump in FIG. 1.

In FIG. 5, sections e-f, f-g, g-h and h-i represent the suction stroke, the transfer stroke, the compression stroke and the discharge stroke, respectively. In the semiconductor manufacturing process in which a vacuum pump capable of discharging gas at a level or rate of 1000 l/min is required, dichlorsilane and ammonia are supplied as process gas at levels of several tens of cc/min and several hundreds of cc/min, respectively. As apparent from the diagram, the pressure of the process gas is remarkably high in the compression and the discharge strokes. However, the partial pressures of dichlorsilane and ammonia can be lowered to the levels of 1/10 to 1/100 of that in a conventional pump by injecting inert gas such as nitrogen gas or argon gas at several l/min to several tens l/min into the working chambers of the pump through the gas purge hole 16.

In the embodiment of FIGS. 1–3, the partial pressure of the process gas is remarkably reduced thereby preventing ammonium chloride ($NH_4Cl$) from accumulating on the male and female rotors 4 and 5 and the inner wall of the casing 1.

Figure 6:
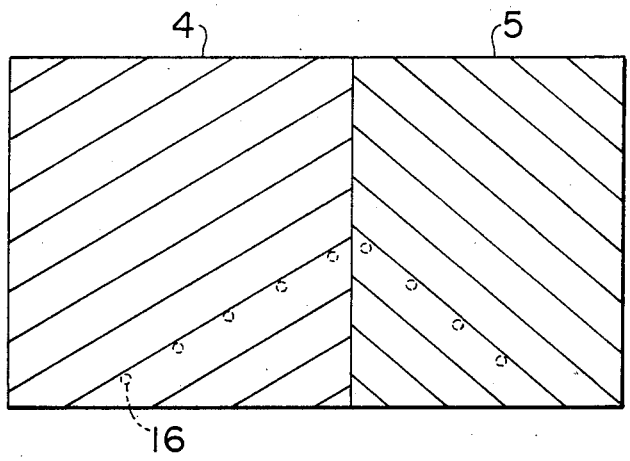
FIG. 6 is a view showing an engagement between tooth spaces of the rotors in another embodiment.

In the embodiment of FIG. 6, the positions of the gas purge holes 16 provided in the main casing portion 11 are indicated in a development of the rotor tooth spaces with the gas purge holes being opened along the tooth spaces of the rotors 4 and 5, so that the process gas is well mixed with the inert gas (nitrogen gas) to reduce the partial pressure of the process gas in the respective working chambers of the pump.

Figure 7:
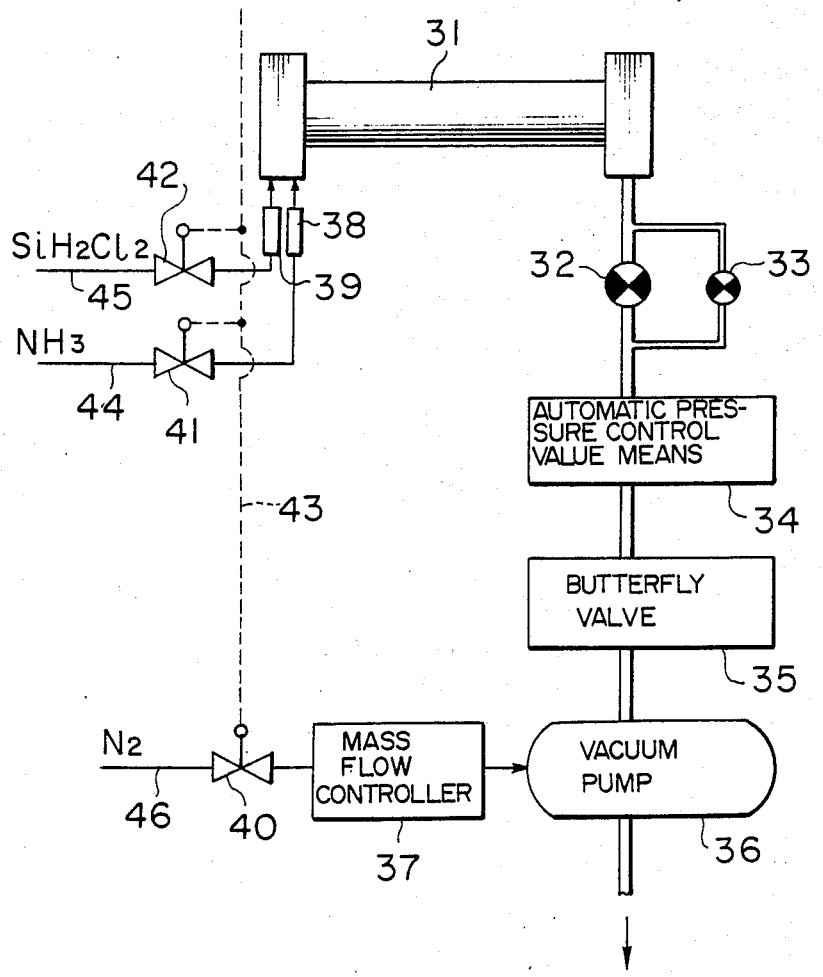
FIG. 7 is a diagram showing a CVD device to which the vacuum pump according to the present invention is applied.

Next, the system of a low-pressure CVD device for manufacturing silicon nitride film will be explained hereinunder with referring to FIG. 7, to which the screw type vacuum pump according to still another embodiment is applied.

The screw type vacuum pump 36 is communicated with one end (discharge side end) of a reaction chamber 31 through a butterfly valve 35, and automatic pressure control valve means 34, and a main valve 32 and a slow discharge valve 33 disposed parallel to the main valve 32. Two gas passage lines 44 and 45 are in communication with the other end (suction side end) of the reaction chamber 31 through solenoid valves 41 and 42 and mass flow controllers 38 and 39, respectively. A nitrogen gas supply passage line 46 is communicated with the vacuum pump 36 through a solenoid valve 40 and a mass flow controller 37. Each of mass flow controllers 37, 38 and 39 is a fine flow control means and can always control a flow rate of gas passing through a passage line to which it is mounted. The mass flow controller includes a flow rate sensor, a control valve and a control circuit therefor. The automatic pressure control valve means 34 serves to keep the pressure in the reaction chamber 31 at a predetermined level during reaction therein. The valve means 34 detects the pressure in the discharge side end of the reaction chamber 31 by a detecting means (not shown) and operates to keep such detected pressure in a predetermined level. In case that the pressure control in the reaction chamber 31 is effected by a drive control of the vacuum pump 36, the valve means 34 is not necessary.

The butterfly valve 35 is normally in an open position. The valve 35 is closed, for example, to repair or maintain the vacuum pump 36. The solenoid valves 40, 41 and 42 are opened or closed in response to a command signal from through a control line 43.

Dichlorsilane ($SiH_2Cl_2$) flows in the gas passage line 45 into the reaction chamber 31 through the solenoid valve 42 and the mass flow controller 39. On the contrary, ammonia ($NH_3$) flows in the gas passage line 44 into the reaction chamber 31 through the solenoid valve 41 and the mass flow controller 38. Nitrogen gas ($N_2$) flows in the gas supply passage line 46 into the gas purge hole 16 of the pump 36 though the solenoid valve 40 and the mass flow controller 37. In this system, a common flow meter can be used instead of the mass flow controllers 37 and 39.

The main valve 32 has a discharge capacity larger than that of the slow discharge valve 33. Both valves 32 and 33 are always closed when the pump 36 is not in operation. The slow discharge valve 33 is changed to an open position on an initial operation stage of the pump 36 and discharge process gas from the reaction chamber 31 at a low flow rate. After a predetermined time elapses, the main valve 32 is also changed to an open position to cooperate with the slow discharge valve 33 to discharge process gas from the reaction chamber 31 at a maximum flow rate.

When the valve open command signal is delivered through the control line 43 to the solenoid valves 41 and 42, they are opened to introduce dichlorsilane and ammonia into the reaction chamber 31. The valve open command signal is also delivered to the solenoid valve 40 to open it. Nitrogen gas is introduced into the working chamber means 6 of the pump 36 to reduce the partial pressure of the process gas (dichlorsilane gas and ammonia gas) in the pump 36. When the valve close command signal is delivered through the control line 43 to the solenoid valves 41 and 42, they are closed to block the flow of process gas into the reaction chamber 31. Simultaneously the solenoid valve 40 is also closed to block the flow of nitrogen gas into the pump 36, so that the base pressure in the reaction chamber 31 is kept in sufficiently low level.

Accordingly, the partial pressure (density) of process gas in the pump 36 is reduced, so that it is difficult for the side reaction product to be deposited in the pump 36. The inert gas is adiabatically compressed to generate heat to heat the rotors and the casing wall of the pump 36. This prevents the side reaction product from accumulating on the rotors and the casing wall of the pump 36, whereby improving the reliability of the pump 36.

Figure 8:
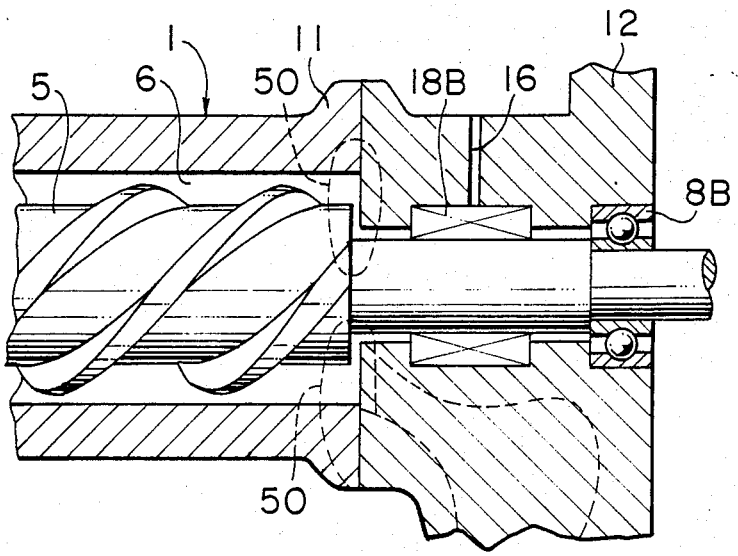
FIG. 8 is a fragmentary sectional view showing still another embodiment.
Figure 9:
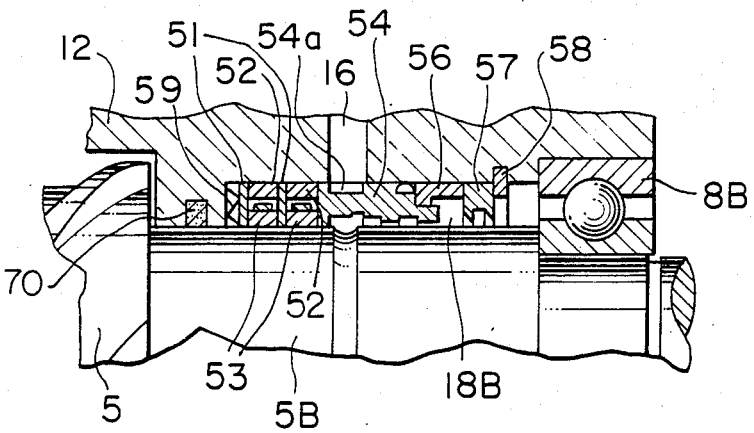
FIG. 9 is an enlarged fragmentary sectional view showing the sealing portion in FIG. 8.

In the embodiment of FIGS. 8 and 9, the gas purge hole 16 for introducing inert gas into the pump is so provided in the discharge side casing portion 12 that the introduced inert gas is directed towards the discharge side sealing means 18B. Upon operation of the screw type vacuum pump, the inert gas such as nitrogen gas or argon gas is introduced towards the sealing means 18B through the gas purge hole 16. The flow of the introduced inert gas is divided into two flows, one for the bearing 8B and the other for the working chamber means 6.

The other flow of the inert gas towards the working chamber means 6 is sucked thereinto by negative pressure generated in a space 50 defined by ends of the discharge side casing portion 12 and of the rotor 5. The inert gas sucked into the working chamber means 6 is adiabatically compressed therein to generate heat to heat the rotors 4 and 5 and the wall of the casing 1. Accordingly, the side reaction product generated in semiconductor manufacturing process is fully discharged without accumulating on the rotors and the casing wall.

Further the inert gas is added to the process gas to reduce the partial pressure (density) thereof, so that it is difficult for the side reaction product bo be deposited in the pump 36.

The one flow of the inert gas towards the bearing 8B prevents the lubricating oil from leaking from the bearing 8B to the working chamber means 6.

As shown in FIG. 9, the sealing means 18B includes a first seal ring 51, a first spacer 52, a first carbon ring 53 accommodated within the first spacer 52, a second seal ring 51, a second spacer 52, a second carbon ring accommodated in the second spacer 52, a screw seal 54, a seal retainer 56 and a labyrinth 57 serving as a slinger. A ring 58 and a wave spring 59 are so disposed that the respective sealing members are clamped therebetween so as to fix the sealing means 18B in an axial position. The screw seal 54 is provided with a gas guide groove **54*a* opposite to an opening of the gas purge hole 16. Accordingly, the introduced inert gas is smoothly delivered towards the sealing means 18B. The inert gas flows in a gap between the outer periphery of the shaft 5B and the inner peripheral surface of the respective sealing members such that the inert gas introduced from the purge hole 16 is divided into two flows toward the working chamber means 6 and the bearing 8B**, respectively, through the gap.

In the embodiment of FIG. 9, in addition to the sealing members of the sealing means 18B, a seal 70 of a felt-like material is disposed adjacent the working chamber 6 and is mounted in an annular groove formed in an inner wall of the discharge side casing portion 12 so as to contact an outer periphery of the discharge side rotor shaft 5B. Accordingly, by virtue of the nature of the felt-like material of the seal 70, dust is prevented from flowing through the working chamber means 6 to the bearing 8B through the sealing means 18B, which dust is, for example, deposited reaction product generated from gases between the working chamber means 6 and an outlet (not shown) in a semiconductor manufacturing device. Moreover, a gas tightness of the working chamber means 6 is improved so that a higher negative pressure can be obtained.

A part of the inert gas introduced from the gas purge hole 16 is sucked into the working chamber means 6 and is adiabatically compressed therein to generate heat to heat the rotors and the casing wall. In general, a reaction product generated in a semiconductor manufacturing process remains in a gaseous form when heated, not deposit as solid substance. Therefore, the process gas can be discharged through the discharge outlet without clogging the pump.

While FIG. 9 only shows the structure of the discharge side sealing means 18B, it should be noted that the suction side sealing means 18A has the same structure as the discharge side sealing means 18B except for the gas purge hole 16. However, it may be possible to introduce the inert gas from not only the discharge side sealing means 18B but also the suction side sealing means 18A by making the structure of the suction side sealing means 18A identical to that of the discharge side sealing means 18B.

Further it should be noted that the structure relating to the male rotor 4 is the same as the female rotor 5 explained hereinabove.

In this embodiment, since the partial pressure (density) of the process gas in the pump is reduced, the deposition of side reaction product is inhibited. Further, by introducing the inert gas into the sealing means in an amount large enough to be adiabatically compressed to obtain heat by which the deposition of reaction product on the rotors 4 and 5 and the inner casing wall is inhibited, the pump may be used as a screw type dry vacuum pump for roughly discharging the reaction product from a line of a device, e.g. a semiconductor manufacturing device in which a great amount of reaction product is generated.

Further in case of a CVD device, it is a common practice to dilute the process gas discharged from the vacuum pump with diluter nitrogen gas and to discharge the process gas and nitrogen gas to the scrubber from a safety point of view. In this embodiment, since nitrogen gas is delivered to the sealing means, such diluter nitrogen gas may be omitted. In addition, since the dilution is carried out within the vacuum pump, it is possible to enhance the safety in operation of the vacuum pump.

It is also possible to prevent lubricating oil from leaking from the bearings and the timing gears to the working chamber means through the sealing means.

The inert gas flowing toward the discharge side bearings urges lubricating oil to a gear case incorporating the timing gears. Accordingly, lubricating oil is prevented from leaking into the working chamber means to obtain a clean vacuum.

On the other hand, since the inert gas accumulates within the gear case to increase the pressure therein, it becomes necessary to release the accumulated inert gas therefrom through vent means. However, since such inert gas contains the lubricating oil, it is preferable to separate lubricating oil from the inert gas and return it to an oil sump in the gear case.

Figure 10:
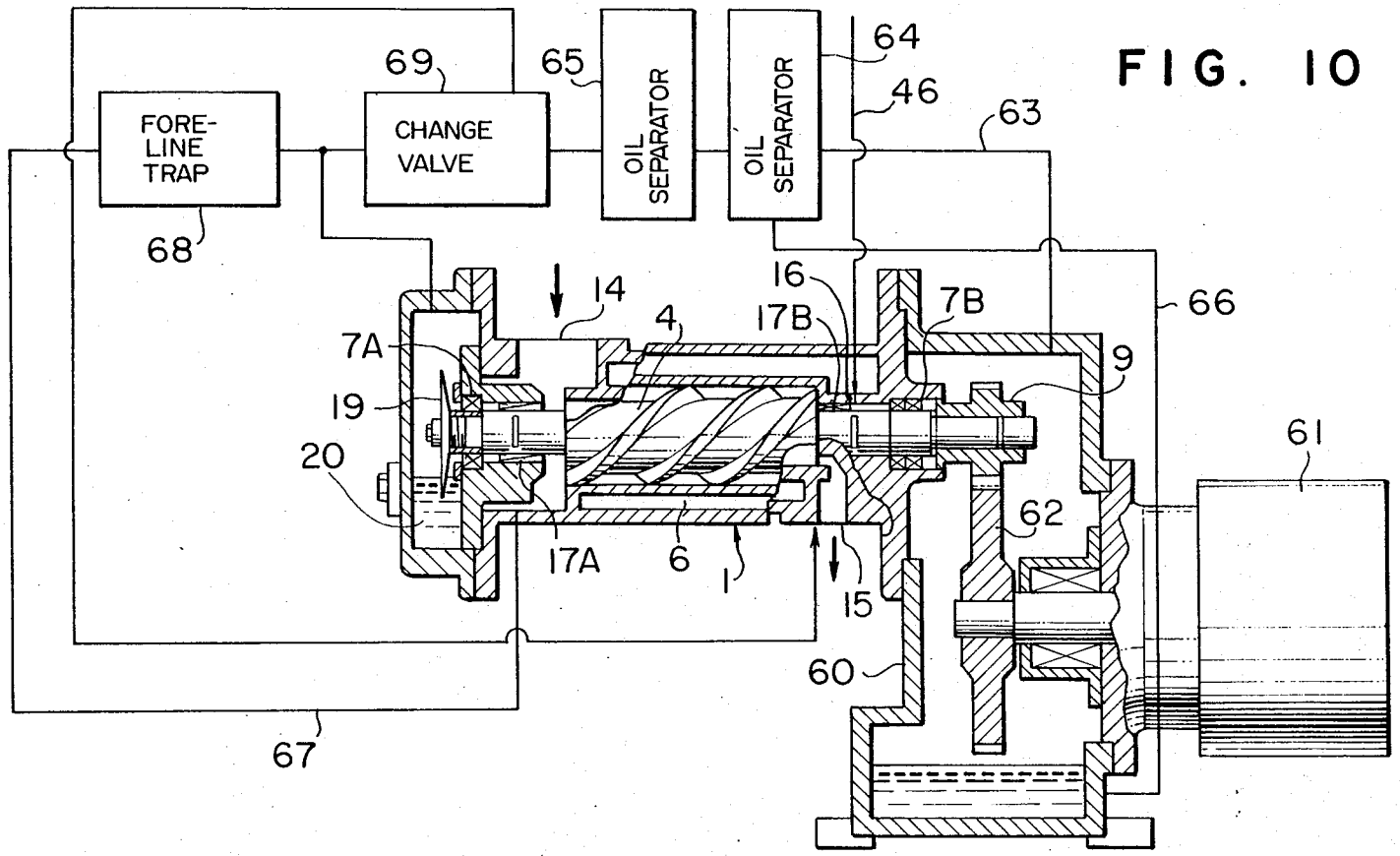
FIG. 10 is sectional view showing a further still another embodiment.

For this purpose, as shown in FIG. 10, the gear case 60 attached to the casing 1 accommodates therein a pair of timing gears and an accelerating gear 62 fitted onto an output shaft of a motor 61 for meshing with the timing gear 9 of the timing gears. The gear case 60 accumulates a predetermined amount of lubricating oil which is supplied from an oil pump (not shown) through a supply nozzle (not shown) provided on the gear case 60.

A first pressure balance line 63 extends from the gear case 60 to the discharge outlet 15 with a first oil separator 64 and a second oil separator 65 being disposed in series in the first pressure balance line 63. Lubricating oil separated from the inert gas in the first oil separator 64 is returned to the oil sump in the gear case 60 through a return line 66.

A second pressure balance line 67 extends from a top of the end cover 13 to the suction inlet 14 so as to balance the pressures at the suction side oil sump 20 and the suction inlet 14. A notrogen gas supply passage line 46 is communicated with the gas purge hole 16 serving as an inert gas introducing means. A fore-line trap 68 is disposed in the second pressure balance line 67. A change valve 69, e.g. a three way solenoid valve, is disposed in the first pressure balance line 63 between the second oil separator 65 and the discharge outlet 15. The change valve 69 is changed over to communicate the gear case 60 to the oil sump 20 during a predetermined period after operation of the vacuum pump. Thereafter, the change valve 69 is changed over to reduce or maintain the inert gas pressure within the gear case 60 within a predetermined level to balance the gear case 60 upon an inert gas extraction.

The suction inlet 14 is connected to a vessel to be evacuated to introduce gas from the vessel in the direction of an arrow into the working chamber means 6. The introduced gas is released from the discharge outlet 15 to the atmosphere through a discharge line and a silencer (both not shown).

Lubricating oil accumulated in a bottom of the gear case 60 is dispensed to portions to be lubricated respectively through an oil pump, an oil cooler and oil supply lines which are not shown.

Upon operation of the vacuum pump, the inert gas containing lubricating oil passes through the first oil separator 64 in which a large part of lubricating oil is separated from the inert gas and is returned to the gear case 60 through the return line 66. The first oil separator 64 must cause little or negligible pressure loss. If the first oil separator 64 causes a large pressure loss, the pressure at an interior of the first oil separator 64 becomes lower than that at an inlet of the separator 64, which is identical with the pressure in the gear case 60. Consequently, lubricating oil and inert gas flow back from the gear casing 60 (a lower pressure part) to an interior of the first oil separator 64 (a higher pressure part).

The remainder lubricating oil is separated from the inert gas in the fine oil separator 65 and the inert gas containing no lubricating oil is delivered to the discharge outlet 15. Fine lubricating oil passing through the second pressure balance line 67 is adsorbed by the fore-line trap 68.

As described above, in accordance with this embodiment, since lubricating oil contained in the inert gas to be supplied to the discharge side sealing means is removed from the inert gas, a complete dry screw type vacuum pump having improved seal performance is provided.

What is claimed is:

1. A screw type vacuum pump comprising:

a pump casing having a working chamber means, a suction inlet and a discharge outlet;

a pair of rotors incorporated within said working chamber means of said pump casing and rotatively carried at opposite ends thereof, said rotors meshing with each other to rotate in a synchronized manner;

first bearing means provided in a portion of said pump casing associated with said suction inlet for carrying said rotor;

second bearing means provided in a portion of said pump casing associated with said discharge outlet;

sealing means disposed in said pump casing and respectively associated with said first and second bearing means; and means provided in said pump casing for introducing inert gas into said working chamber means towards at least the sealing means associated with the second bearing means thereby preventing a deposition of a process gas handled by the vacuum pump from accumulating on components of the vacuum pump.

2. A screw type vacuum pump comprising:

a pump casing;

rotor means disposed within said pump casing;

bearing means provided in said pump casing and disposed at respective opposite ends of the rotor means for rotatably supporting said rotor means;

sealing means disposed in said pump casing and associated with the respective bearing means provided at opposite ends of the rotor means, said sealing means including a carbon ring, a spacer disposed between said carbon ring and a respective end of said rotor means, a seal retainer disposed between said carbon ring and associated bearing means, and labyrinth means disposed adjacent said seal retainer; and means provided in said pump casing for introducing inert gas into a working chamber means accommodating the rotor means towards at least one of the sealing means thereby preventing a deposition of a process gas handled by the vacuum pump from accumulating on components of the vacuum pump.

3. A screw type vacuum pump comprising:

a pump casing having a suction inlet and a discharge outlet;

a pair of rotors incorporated within said pump casing and meshing with each other to rotate in a synchronized manner;

bearing means provided in said pump casing at opposite ends of said rotor for rotatably carrying said rotors;

working chamber means defined by said rotors and said pump casing; and means for introducing inert gas into said working chamber means toward at least one of said bearing means thereby preventing a deposition of process gas handled by the vacuum pump from accumulating on components of the vacuum pump.

4. A screw type vacuum pump comprising:

a pump casing having a suction inlet and a discharge outlet;

a pair of rotors incorporated within said pump casing and meshing with each other to rotate in a synchronized manner;

bearing means provided in said pump casing at opposite ends of said rotor for rotatively carrying said rotors;

working chamber means defined by said pump casing and said rotors, said working chamber means including a first working chamber for suctioning a process gas therein, a second working chamber for compressing said process gas, and a third working chamber for discharging said process gas therefrom;

means for introducing inert gas into said working chamber means towards at least one of said bearing means thereby preventing a deposition of the process gas handled by the vacuum pump from accumulating on components of the vacuum pump; and flow control means for exclusively allowing said inert gas passing into said working chamber means when said process gas is being suctioned into said working chamber means.

5. A screw type vacuum pump comprising:

a pair of rotors each provided with a plurality of spiral lands and a plurality of spiral grooves, said rotors meshing with each other to rotate around the respective axes substantially parallel to each other in a synchronized manner;

a pump casing incorporating said rotors therein;

a pair of working chambers defined by said rotors and said pump casing along the respective grooves of said rotors, one of said working chambers compressing and discharging a process gas, and the other of said working chambers suctioning and transferring the process gas; and means for introducing inert gas into one of said working chambers at least in a direction of bearing means rotatively supporting the rotors in said pump casing thereby preventing a deposition of a process gas handled by the vacuum pump from accumulating on components of the vacuum pump.

6. A screw type vacuum pump comprising:

a pump casing having a suction inlet and a discharge outlet;

a pair of rotors incorporated within said pump casing and meshing with each other so as to rotate;

bearing means provided in said pump casing at opposite ends of said rotor for rotatively carrying said rotors;

working chamber means defined by said pump casing and said rotors;

gear means for transmitting a rotational force to said rotors;

a gear case means incorporating said gear means therein;

means for introducing inert gas into said working chamber means toward at least one of said bearing means thereby preventing a deposition of a process gas handled by the vacuum pump from accumulating on components of the vacuum pump; and means for extracting said inert gas from said gear case.

7. A screw type vacuum pump comprising:

a pump casing having a suction inlet and a discharge outlet;

a pair of rotors incorporated within said pump casing and meshing with each other to rotate in a synchronized manner;

bearing means provided in said pump casing at opposite ends of said rotors for carrying said rotors;

working chamber means defined by said pump casing and said rotors;

gear means for transmitting a rotational force to said rotors;

gear case means incorporating said gear means therein;

means for introducing inert gas into said working chamber means toward at least one of said bearing means thereby preventing a deposition of a process gas handled by the vacuum pump from accumulating on components of the vacuum pump; and means for extracting said inert gas from said gear case including oil separator means for separating said inert gas from oil, and passage line means for respectively delivering said separated inert gas and said oil to said discharge outlet and said gear case.

8. A screw type vacuum pump comprising:

a pump casing having a suction inlet and a discharge outlet;

a pair of rotors incorporated within said pump casing and meshing with each other to rotate in a synchronized manner;

bearing means provided in said pump casing at opposite ends of said rotors for carrying said rotors, said bearing means being respectively associated with the suction inlet and discharge outlet of the pump casing;

sealing means disposed in said pump casing associated with the respective bearing means;

gear means for transmitting rotational force to said rotors;

a gear case incorporating said gear means therein;

means for introducing inert gas into the sealing means associated with the bearing means associated with said discharge outlet; and means for extracting said inert gas from said gear case, said extracting means including oil separator means for separating said inert gas from oil, passage line means for delivering said oil into said gear case, and change valve means for delivering said separated inert gas to said suction inlet during a predetermined period after operation of said pump and for delivering said separated inert gas to said discharge outlet after a lapse of said predetermined period.

* * * * *